US006945069B2

(12) United States Patent
Lee et al.

(10) Patent No.: US 6,945,069 B2
(45) Date of Patent: Sep. 20, 2005

(54) QUICK COOLING DEVICE

(75) Inventors: Myung Ryul Lee, Sungnam-si (KR); Seong Jae Kim, Ansan-si (KR); Wook Yong Lee, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 36 days.

(21) Appl. No.: 10/693,959

(22) Filed: Oct. 28, 2003

(65) Prior Publication Data

US 2004/0144103 A1 Jul. 29, 2004

(30) Foreign Application Priority Data

Jan. 24, 2003 (KR) ..... 10-2003-0004844
Jan. 24, 2003 (KR) ..... 10-2003-0004845
Jan. 24, 2003 (KR) ..... 10-2003-0004843
Feb. 25, 2003 (KR) ..... 10-2003-0011656

(51) Int. Cl.[7] ..... F25D 24/00; F25D 3/02; F25D 3/08

(52) U.S. Cl. ..... 62/378; 62/457.4

(58) Field of Search ..... 62/529, 530, 457.2, 62/457.3, 457.4, 378, 379

(56) References Cited

U.S. PATENT DOCUMENTS 4,164,851 A * 8/1979 Bryant ..... 62/381
4,580,405 A * 4/1986 Cretzmeyer, III ..... 62/63
4,715,195 A * 12/1987 Kucza ..... 62/376
5,966,964 A * 10/1999 Pattee ..... 62/457.4
6,314,751 B1 * 11/2001 Gjersvik ..... 62/457.4
6,502,406 B2 * 1/2003 Niehaus ..... 62/3.64
6,691,530 B2 * 2/2004 Lee et al. ..... 62/378

FOREIGN PATENT DOCUMENTS

JP 2002-013855 1/2002

OTHER PUBLICATIONS

English Language Abstract of 2002–013855.

* cited by examiner

*Primary Examiner*—William C. Doerrler
(74) *Attorney, Agent, or Firm*—Greenblum & Bernstein, P.L.C.

(57) ABSTRACT

A quick cooling device quickly cools a canned or bottled drink from room temperature. The quick cooling device has a case with an inside space divided into a cavity and a device chamber, and a door is provided on a front part of the case for opening or closing the cavity. Within the cavity, a cold accumulation pack contacts a bottled drink container, and the cold accumulation pack and bottled drink container are shaken together to cool the drink in the bottled drink container. A refrigerating system is provided in the case for cooling the cold accumulation pack.

24 Claims, 11 Drawing Sheets

— canned beverage−1(the first experiment)
--- canned beverage−1(the second experiment)
— canned beverage−2(the first experiment)
--- canned beverage−2(the second experiment)

QUICK COOLING DEVICE

This application claims the benefit of the Korean Application Nos. P2003-0004843, P2003-0004844, and P2003-0004845, three of which are filed on Jan. 24, 2003, and P2003-0011656, which is filed on Feb. 25, 2003 and hereby incorporated by reference.

BACKGROUND OF THE INVENTION

1. Field of the Invention

The present invention relates to cooling devices, and more particularly, to a quick cooling device for cooling canned or bottled drink quickly within a short time period from a room temperature.

2. Background of the Related Art

In general, when it is intended to cool the canned or bottled drink, the drink is placed in a refrigerating chamber or a freezing chamber of a refrigerator for cooling. However, the cooling of drink in the refrigerator from room temperature requires at least a few tens of minutes. Therefore, the desire of the user for quick cooling cannot be satisfied.

Consequently, devices are developed recently, in each of which the drink is cooled quickly by a method in which a quick cooling device is provided to the freezing chamber or refrigerating chamber of the refrigerator, and concentrating cold air to the quick cooling device, to cool the canned or bottled drink.

However, since the related art quick cooling device takes a comparably long time in cooling entire drink in a can or bottle, even if the cooling with the related art quick cooling device takes shorter than a general freezing, the desire of the user for drinking cold drink within a short time right after physical exercise, or in a hot weather can not be satisfied.

Moreover, even if cooling packs for cooling beverages, such as wine, are under development, since the cooling of the cooling packs only relies on thermal conduction, the cooling rate is low.

SUMMARY OF THE INVENTION

Accordingly, the present invention is directed to a quick cooling device that substantially obviates one or more of the problems due to limitations and disadvantages of the related art.

An object of the present invention is to provide a quick cooling device for cooling canned or bottled drink quickly within a short time period.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the quick cooling device includes a case having an inside space divided into a cavity and a device chamber. The quick cooling device may also have a cavity door on a front part of the case for opening/closing the cavity, and means in the cavity, for bringing a cold accumulation pack into contact with a drink container. Further, the quick cooling device may include means for shaking the cold accumulation pack and the drink container together, to quickly cool down drink in the container, and a refrigerating system in the case for cooling the cold accumulation pack.

The case may include an insulating material attached to an inside surface of the wall of the cavity. The cavity door may be hinge coupled to one side of the case. The case may include a front plate attached to a surface having the cavity door attached thereto so as to be in contact with the cavity door, and having an opening to make the cavity in communication with an exterior.

The refrigerating system includes a compressor for compressing and transferring refrigerant, a condenser for condensing transferred refrigerant, an expansion device for expanding condensed refrigerant, and an evaporator for cooling the cavity by using a heat absorption reaction taking place when the expanded refrigerant is evaporated. The compressor and the condenser may be in the device chamber. The refrigerating system may further include a fan for blowing air to the compressor and the condenser.

The case may include an air inlet adjacent to the fan for introducing external air into the device chamber, and an air outlet adjacent to the compressor and the condenser for discharging the air cooled the compressor and the condenser to an exterior. The evaporator may be in the cavity. The refrigerating system may further include a fan for supplying cold air around the evaporator to the cold accumulation pack.

The cold accumulation pack may include a cold accumulation material for being cooled down to a low temperature by the refrigerating system, and a soft bag for storing the cold accumulation material therein. The cold accumulation material is a solution of sodium chloride, or potassium chloride, having a freezing point in a range of −7° C.~−20° C.

In the meantime, the quick cooling device of the present invention can be embodied in a variety of forms. In the quick cooling device in accordance with a first preferred embodiment of the present invention, the means includes a motor having a reversible rotation shaft, a shaking case with many holes in the cavity for rotating following rotation of the rotation shaft, a low temperature cold accumulation pack in the shaking case for being brought into close contact with the container introduced into the shaking case, and rotating with the container, to cool down the drink in the container, quickly.

The means may further include a rotation guide having circular outside surface surrounding the shaking case, and a plurality of rollers in the cavity in contact with the rotation guide for supporting the shaking case and guiding rotation of the rotation guide.

The shaking case may include a body with many holes having opened front part and upper part, and a space therein, and a shaking case door for opening/closing the front and upper parts of the body.

The cold accumulation pack is mounted on an underside of the shaking case door in a soft state. In the meantime, The cold accumulation pack is mounted on the underside of the shaking case door and on a bottom surface of the body.

In the quick cooling device in accordance with a second preferred embodiment of the present invention, the means includes first and second cold accumulation packs for surrounding an outside surface of the container with drink therein from opposite sides, a frame in the cavity having the cold accumulation packs provided therein, and a shaking device for rotating the frame repeatedly or reciprocating on a straight line.

The first and second cold accumulation packs are formed of a soft material for free deformation in conformity with an outside shape of the container with the drink. The shaking device may be a motor connected to one side of the frame for rotating the frame in left or right direction, or moving the frame back and forth.

The frame may include a base having one surface the cold accumulation pack fixed thereto, and one side the shaking device connected thereto, an elevating plate having one surface opposite to the first cold accumulation pack the second cold accumulation pack fixed thereto, for moving up/down in a space over or under the base, and an elevating device for moving the elevating plate up/down.

The elevating device includes guide members each standing on the frame vertically and extended to pass through the elevating plate, and a driving device for moving the elevating plate in an up/down direction along the members.

The driving device includes a driving motor fixed to one side of the frame, a screw parallel to the guide members to be rotatable following rotation of the driving motor, and a nut fixed to the elevating plate and engaged with the screw.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

The quick cooling device of the present invention includes a case, a cavity door, cooling and shaking means, and a cooling system. Depending on design of the cooling and shaking system, different embodiment can be provided. The embodiments will be described in detail with reference to the attached drawings.

Figure 1:
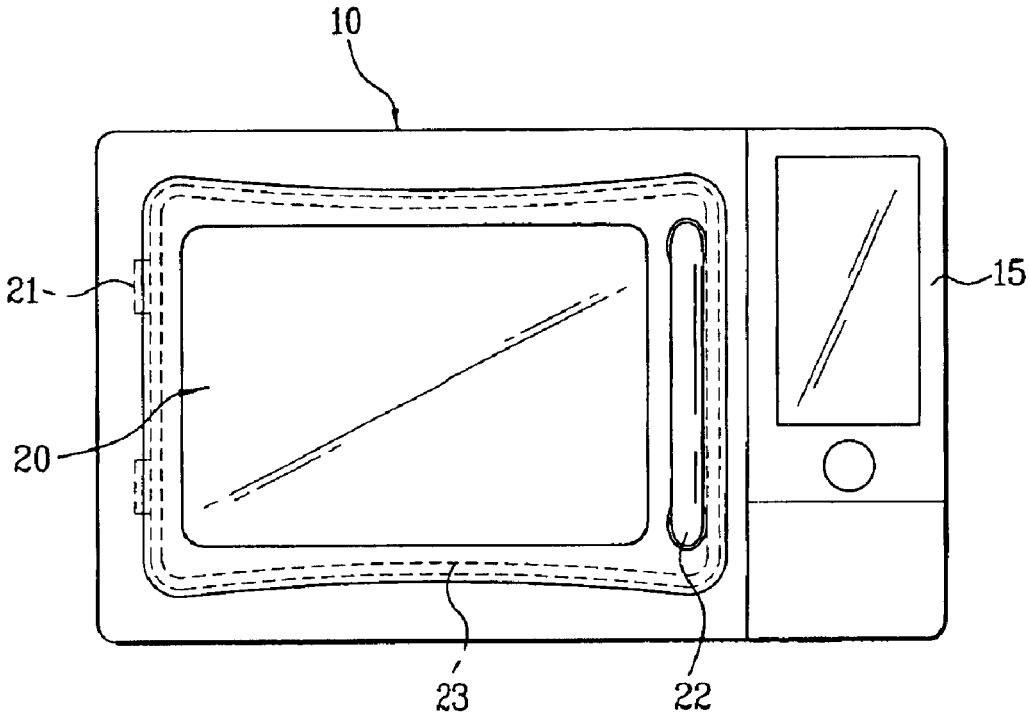
FIG. 1 illustrates a front view of an outer appearance of a quick cooling device of the present invention.
Figure 2:
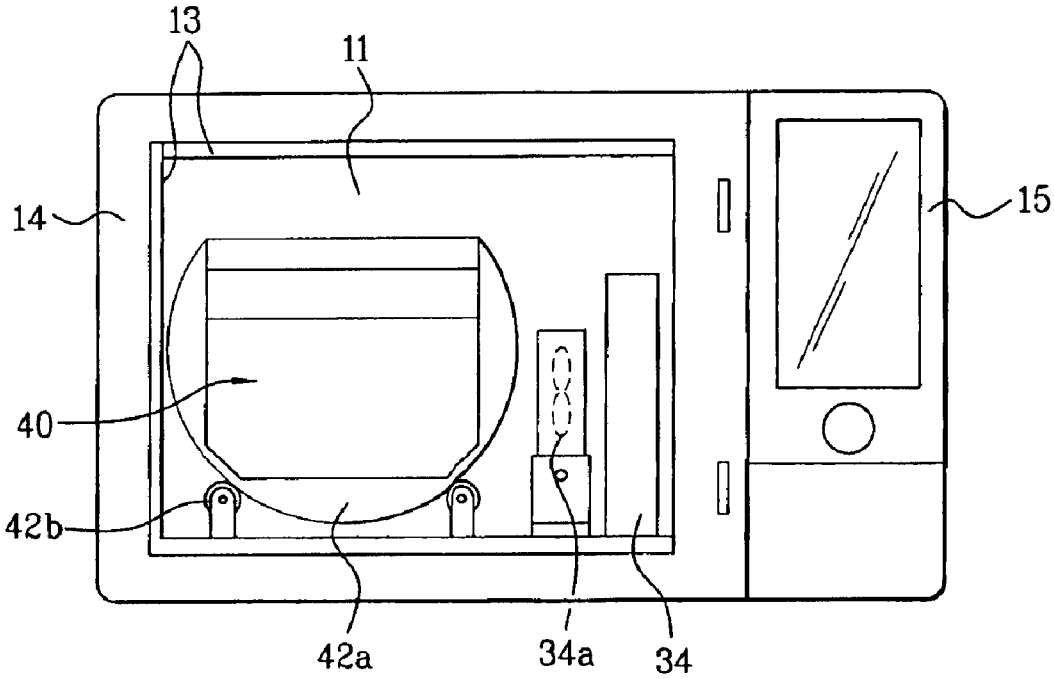
FIG. 2 illustrates a front view of an inner appearance of a quick cooling device in accordance with a first preferred embodiment of the present invention.
Figure 3:
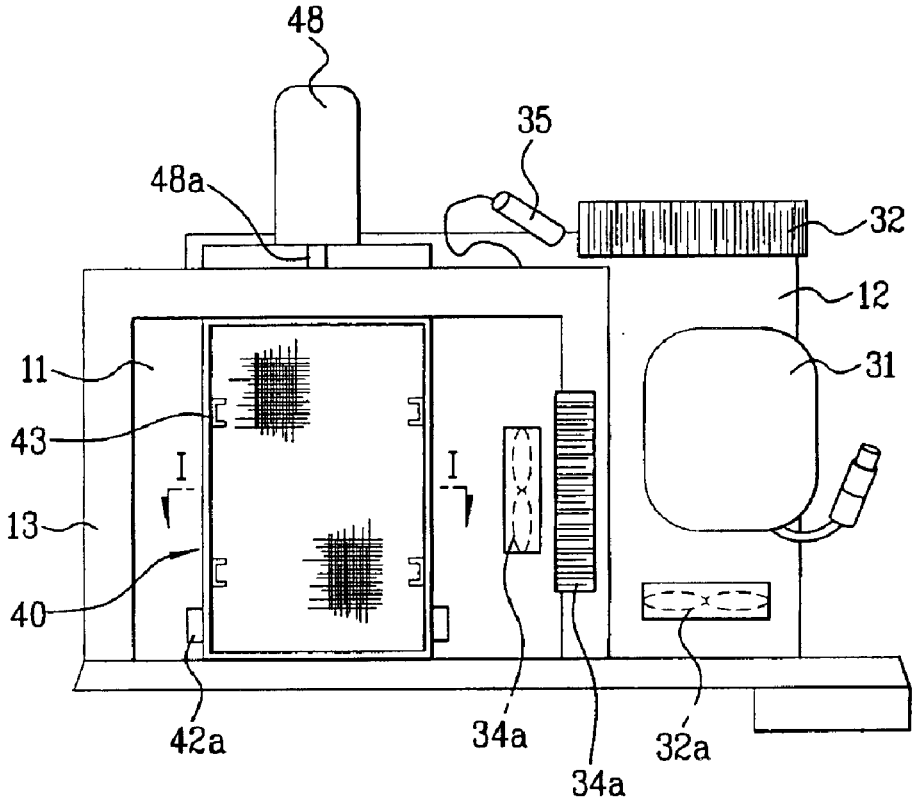
FIG. 3 illustrates a plan view of an inner appearance of a quick cooling device in accordance with a first preferred embodiment of the present invention.

FIG. 1 illustrates a front view of an outer appearance of a quick cooling device of the present invention, FIG. 2 illustrates a front view of an inner appearance of a quick cooling device in accordance with a first preferred embodiment of the present invention, and FIG. 3 illustrates a plan view of an inner appearance of a quick cooling device in accordance with a first preferred embodiment of the present invention.

Referring to FIGS. 1~3, an inside space of a case 10 of the quick cooling device of the present invention is divided into a cavity 11 and a device chamber 12. There is insulating material applied to an inside surface of walls which form the cavity, to insulate the cavity from an exterior.

A front part of the case 10 is opened, to which a door 20 is provided coupled with a hinge 21 at one side of the front part of the case 10, for closing the cavity 11. Referring to FIG. 1, the door 20 is coupled with the hinge 21 at a side far from the device chamber 12, and has a hand grip 22 on a front part of the door 20 adjacent to the device chamber 12. However, the positions of the hinge 21 and the hand grip 22 are not limited to those, but may be changed. That is, though not shown, the hinge 21 of the door 20 may be provided to a lower side of the front part of the case 10, and the hand grip 22 may be provided to an upper side of the front part of the case 10. A configuration opposite to above may also be possible.

There is a front plate 14 attached to a surface the case 10 and the door 20 come into contact, i.e., an opened front surface of the case 10. The front plate 14 is positioned between the case 10 and the door 20, and has an opening making the cavity 11 be in communication with an exterior.

Referring to FIG. 1, there is a sealing member 23 coated along a part of an inside surface of the door 20 facing edges of the opening. Therefore, when the door 20 is closed, the sealing member 23 is brought into contact with the front plate 14, such that air tightness and insulating performance between the cavity 11 and the exterior are improved. Of course, the sealing member 23 may be provided, not to the inside surface of the door 20, but to the front plate 14 along the edges of the opening.

There is cooling and shaking means provided to the cavity 11. In the quick cooling device of the present invention, the cooling and shaking means includes a cold accumulation pack, and the cooling and shaking means are shaken in a state the cold accumulation pack is in contact with a drink container, for cooling the drink quickly. There may be a variety of cooling and shaking means, which will be described in detail, later. A system of the cold accumulation pack used in all the embodiments will be described.

The cold accumulation pack includes a bag and a cold accumulation material stored in the bag. The bag is formed of a soft material, for example a soft plastic, such as polyvinylchloride. The cold accumulation material is cooled down (i.e., stores cold) to a very low temperature, for example, below zero by a refrigerating system described later. The cold accumulation material used in the present invention is a solution of sodium chloride, or potassium chloride, having a freezing point preferably in the range of approximately −7° C.~−20° C. Since the freezing point is dependent on the solvent, proportional to a mole number of the solvent, obtaining a desired freezing point requires a proper combination of the parameters discussed above. Thus, the liquid phase cold accumulation material employed in the present invention has a low freezing point, so that the cold accumulation material can be in a liquid phase without being frozen at a subzero temperature.

There is a device chamber cover 15 in the opened front part of the device chamber 12. The device chamber cover 15 has a control panel with various buttons and control unit for operating the quick cooling device for an exterior. In the device chamber 12, there are various components of the refrigerating system mounted therein. There is a temperature sensor (not shown) in the cavity 11 electrically connected to the control unit in the control panel.

In the quick cooling device of the present invention, the cold accumulation pack is cooled by a refrigerating system. In more detail, the refrigerating system cools the cavity 11, to cool down the cold accumulation pack in the cavity. The refrigerating system that cools the cavity 11 and the cold accumulation pack will be described with reference to the attached drawings.

Figure 4:
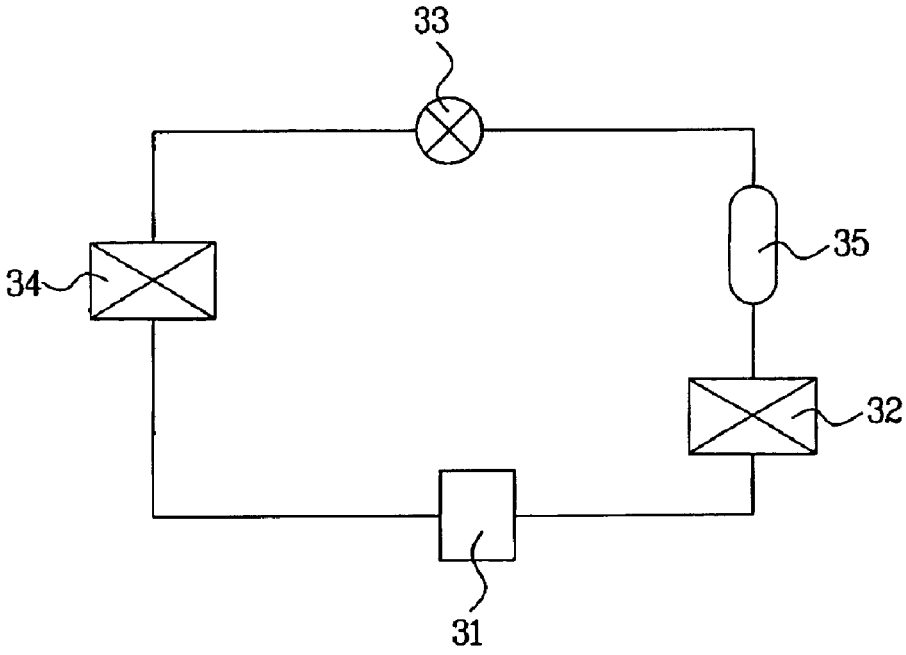
FIG. 4 illustrates a diagram of a refrigerating system in a quick cooling device of the present invention.

FIG. 4 illustrates a diagram of a refrigerating system in a quick cooling device of the present invention.

Referring to FIG. 4, the refrigerating system includes a compressor 31, a condenser 32, an expansion device 33, and an evaporator 34. The refrigerating system, electrically connected to the control unit, is operated under the control of the control unit.

The compressor 31, compressing gas refrigerant to a high pressure and providing to the condenser 32, is mounted in the device chamber 12 as shown in FIG. 3. The condenser 32 in the device chamber 12 condenses the refrigerant from the compressor 31 into liquid refrigerant. The compressor 31 and condenser 32 generate heat. Therefore, the device temperature 12 becomes hot owing to the heat from the compressor 31 and the condenser 32.

For solving the heat problem of the device chamber 12, the quick cooling device of the present invention includes a cooling fan 32*a* in the device chamber 12, for cooling the device chamber 12. The cooling fan 32*a* draws in air from an exterior and blows toward the compressor 31 and the condenser 32. According to this, the compressor 31 and the condenser 32 heat exchanges with the cold air from the cooling fan 32*a*, and are cooled. There are a plurality of air inlets (not shown) and air outlets (not shown) in the case 10 for introducing an external air into the device chamber 12 and discharging the air heat exchanged with the compressor 31 and the condenser 32 to become hot by means of the cooling fan 32*a*.

In the meantime, it is preferable that the quick cooling device of the present invention has the air inlets in a front part of the case 10, and the air outlets in a rear part of the case 10. This is for cooling heat generated at components of the control unit while introducing the cold external air through a front part of the device chamber 12, and, along with this, for avoiding direct contact of the discharging air with the user by discharging air heated as the air cools down the components in the device chamber 12 toward a rear side of the case 10. To do this, it is preferable that the cooling fan 32*a* is mounted on a front part of an inside of the device chamber 12, and the condenser 32 is mounded on a rear part of the inside of the device chamber 12. It is also preferable that the compressor 31 is mounted in the middle of an inside of the device chamber 12 so that the air from the cooling fan 32*a* reaches to the condenser 32 via the compressor 31. The cooling of the control unit by the external air introduced through the front part of the device chamber 12 prevents the control unit from malfunction and becoming out of order due to overheat.

In the refrigerating system, the refrigerant liquefied at the condenser 32 is expanded at the expansion device 33, and comes into a low pressure state. It is preferable that the expansion device 33 is mounted in the vicinity of the evaporator 34. The evaporator 34, mounted in the cavity 11 (for example, adjacent to the device chamber 12,) makes the refrigerant (which is expanded to a low pressure) at the expansion device 33 exchange heat with air in the cavity, to evaporate the refrigerant. Since the refrigerant evaporating in the evaporator 34 absorbs heat from the surroundings of the evaporator 34, the air in the cavity 11 is cooled down. Thus, when the cavity 11 is cooled down by the evaporator 34, the cold accumulation pack in the cavity 11 is also cooled down as the cold accumulation pack exchanges heat with the air in the cavity 11.

In order to improve a heat exchange performance of the evaporator 34 and cooling down the cold accumulation pack effectively, a fan 34*a* is provided to the quick cooling device of the present invention. As shown in FIG. 3, the fan 34*a* is mounted in the cavity 11 adjacent to the evaporator 34. The fan 34*a* blows cold air around the evaporator 34 toward the cavity 11, more preferably, concentrated toward the cold accumulation pack.

There may be a strainer 35 mounted in the refrigerating system. As shown in FIG. 3, the strainer 35 is mounted on a refrigerant pipe line between the condenser 32 and the expansion device 33, for filtering impurities in the refrigerant. The strainer 35 serves, not only filtering the refrigerant, but also removing moisture remained in the refrigerant pipeline when the refrigerant pipeline is evacuated before the refrigerant pipeline is charged with refrigerant in production of the refrigerating system. At least one or more than one strainer 35 of a mesh is fitted in the refrigerant pipeline substantially vertical to a flow direction of the refrigerant.

Thus, the refrigerating system cools down the cold accumulation pack in the cavity 11 to a very low temperature. The cold accumulation pack cooled down thus cools down the drink container put in the cavity 11 quickly as the cold accumulation pack is in contact with the drink container and the cold accumulation material therein is shaken together with the drink. This quick cooling down is done by means of the cooling and shaking means, which will be described in more detail.

Figure 5:
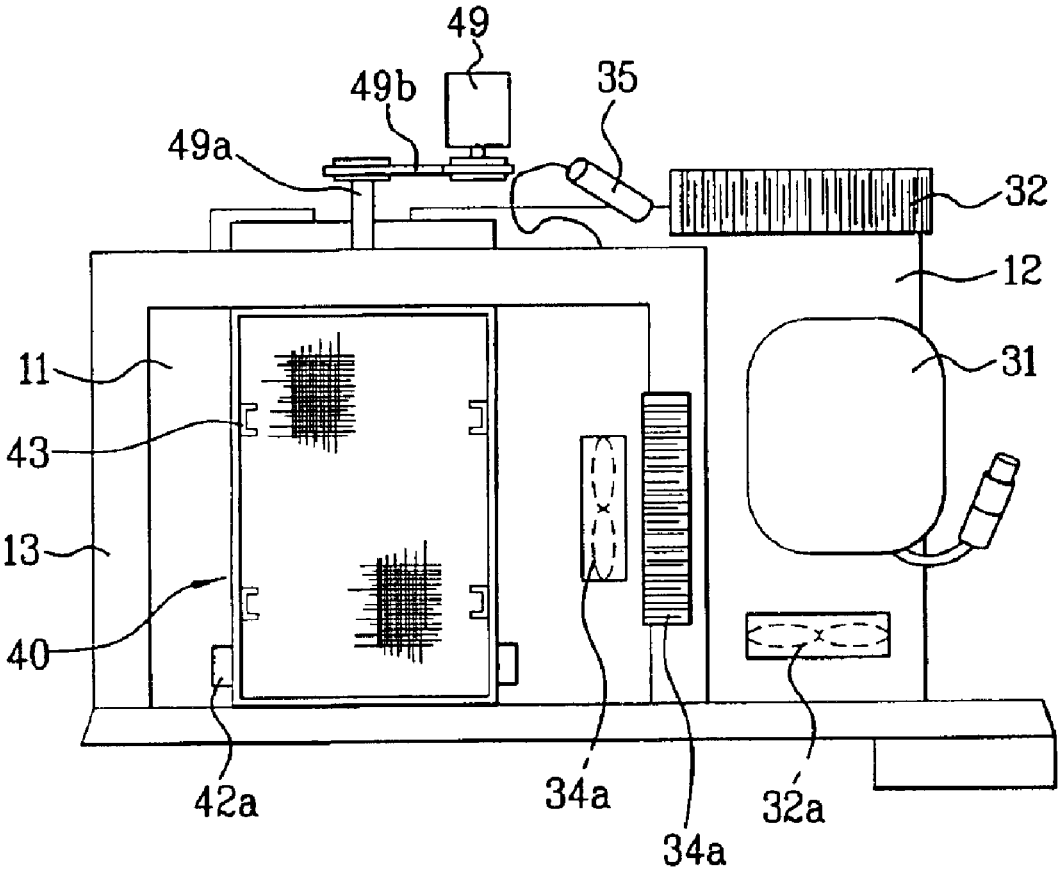
FIG. 5 illustrates a plan view of an inner appearance of a variation of a quick cooling device in accordance with a first preferred embodiment of the present invention.

There may be a variety of the cooling and shaking means. The cooling and shaking means in accordance with a first preferred embodiment of the present invention will be described with reference to FIGS. 2~6. For reference, FIG. 5 illustrates a plan view of an inner appearance of a variation of a quick cooling device in accordance with a first preferred embodiment of the present invention, and FIG. 6 illustrates a disassembled perspective view of cooling and shaking means of a quick cooling device in accordance with a first preferred embodiment of the present invention.

Figure 6:
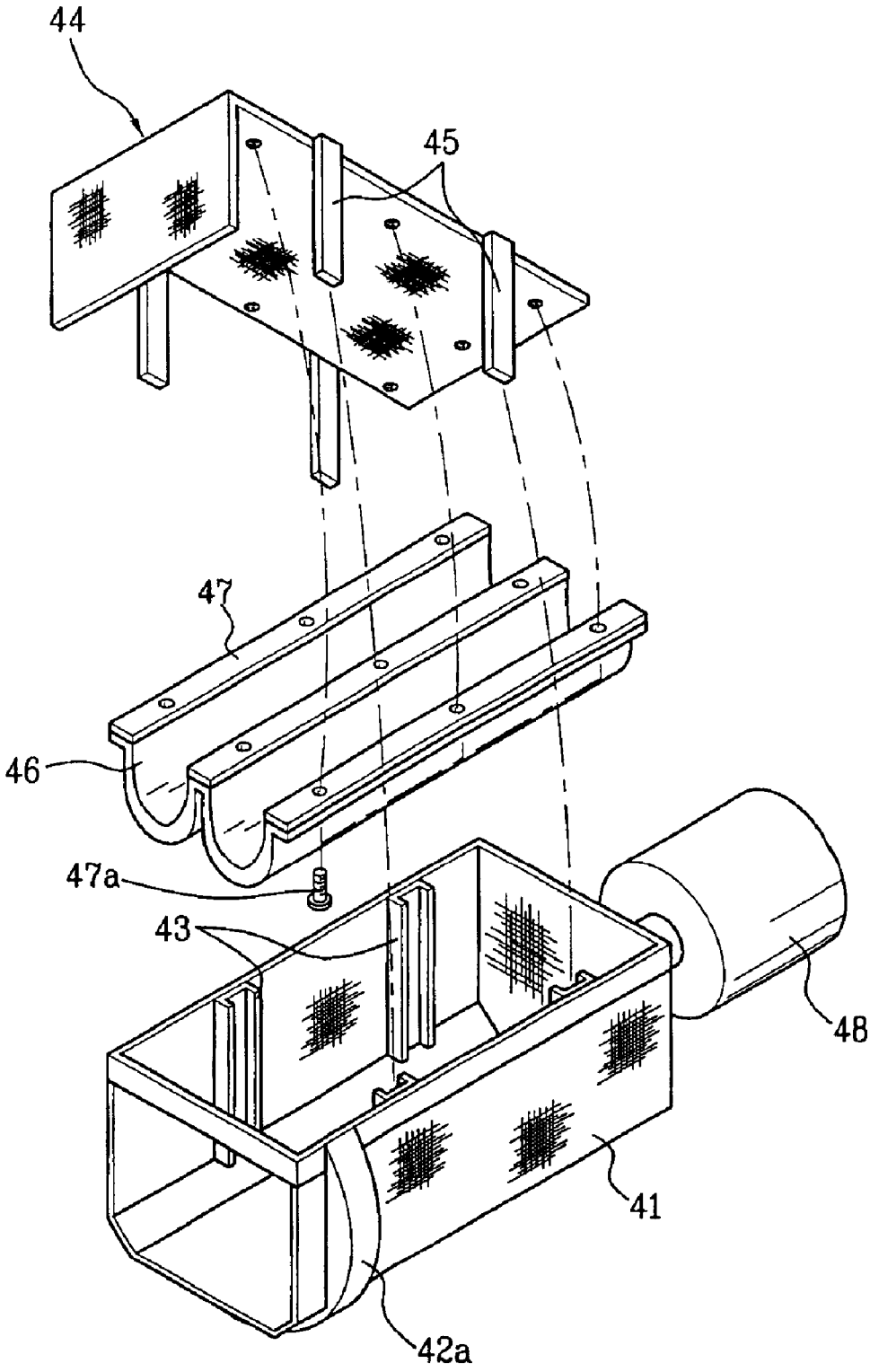
FIG. 6 illustrates a disassembled perspective view of cooling and shaking means of a quick cooling device in accordance with a first preferred embodiment of the present invention.

Referring to FIGS. 2~6, the cooling and shaking means in accordance with a first preferred embodiment of the present invention includes a vibration case 40, a motor 48, and a cold accumulation pack 46. The vibration case 40 is rotatably mounted in the cavity 11. As shown in FIG. 6, the vibration case 40 includes a body 41 and a door 44. The body 41 has a form of container with opened front and upper parts and a space therein. The door 44 opens or closes the opened front and upper parts as the door 44 slides in an up/down direction. To do this, the door 44 has a structure two panels covering the front and the upper parts of the body 41 are joined together. There are a plurality of sliding sticks 45 fixed to opposite sides of, and extended downward vertical from, the panel covering the upper part of the door 44.

There are sliding guides 43 on opposite sides of the body 41 in an up/down direction so that the sliding sticks 45 are inserted therein and sliding in an up/down direction. The door 44 and the body 41 are fabricated of a panel with a plurality of holes, for an example, a mesh type panel. Therefore, the cold air blown by the fan 34*a* can be introduced into the vibration case 40, easily.

In the meantime, the door 44 may be engaged with the body 41 in a method different from above method. For an example, a hinge may be provided at one side of the opened upper part of the body 41 for coupling the door 44 with the body 41. In this instance, no sliding sticks 45 or sliding guides 43 are provided. When the door 44 is coupled with the body 41 thus, the opened front and upper parts of the body 41 may be opened/closed by rotating the doors 44 around the hinge. Therefore, an engaging structure between the vibration case 40 and the door 44 is not limited to the above structure, but the engaging structure may be embodied in a variety of forms as far as the opened front part and upper part of the body 41 can be opened/closed.

The motor 48 is reversible within a predetermined angle of rotation. Therefore, the vibration case 40 rotates in clockwise, and anti-clockwise directions alternately, and repeatedly by the motor 48. Accordingly, the quick cooling device of the present invention is provided with a structure which supports, and guides rotation of the vibration case 40, for facilitating smooth rotation of the vibration case 40 alternately in clockwise and anti-clockwise directions within a predetermined angle.

For this, the vibration case 40 includes a rotation guide 42*a* on the body 41, and a plurality of rollers 42*b* on a bottom surface of an inside of the cavity 11 in contact with an outside surface of the rotation guide 42*a*. The rotation guide 42*a* is formed on an outside surface of the body 41 of the vibration case 40, in more detail, to surround opposite sides and underside of the body 41. The outside surface of the rotation guide 42*a* is a curved surface having a predetermined radius. As shown in FIG. 2, the roller 42*b* is mounted on a support on a bottom of an inside of the cavity 11, such that an outer circumference of the roller 42*b* is in contact with the outside circumference of the rotation guide 42*a*.

In the meantime, it is preferable that the rotation guide 42*a* and the roller 42*b* are provided at a front part of the vibration case 40, i.e., a part opposite to a side adjacent to the motor 48. This is for stable supporting of the vibration case 40, since the front side droops downward by gravity, while the rear side of the vibration case 40 is supported by a rotation shaft of the motor 48.

According to the foregoing structure, as the rotation guide 42*a* and the roller 42*b* rotate together following rotation of the vibration case 40 by the motor 48, a smooth rotation of the vibration case 40 is made. In the meantime, rotation of the motor 48 is not limited to the rotation within the predetermined angle, but the rotation of the motor 48 may be one directional rotation for a predetermined time period.

The vibration case 40 rotated by the motor 48 thus may be connected to the motor 48 directly, or indirectly through an additional power transmission means. In the case of embodiment shown in FIG. 3, one side, for an example, a rear side of the vibration case 40 is connected to the motor 48 directly. The rotation shaft of the motor 48 penetrates the wall and insulating member 13 that forms the cavity 11.

In the meantime, in a case of embodiment shown in FIG. 5, the vibration case 40 is connected to the motor 48 indirectly through an additional power transmission means. In this instance, a first shaft 49*a* extends from one side, for an example, a rear side of the vibration case 40, and a rotation shaft of the motor 48 is spaced from, and arranged in parallel to, the first shaft 49*a*. Then, the first shaft 49*a* and the rotation shaft of the motor 48 are coupled with a belt 49*b* or a chain (not shown).

When the first shaft 49*a* and the rotation shaft of the motor 48 are coupled with the belt 49*b*, pulleys are mounted to the first shaft 49*a* and the rotation shaft of the motor 48 respectively. When the first shaft 49*a* and the rotation shaft of the motor 48 are coupled with the chain, sprockets are mounted to the first shaft 49*a* and the rotation shaft of the motor 48 respectively for winding the chain. On the other hand, though not shown, the rotation shaft of the motor 48 and the body 41 may be engaged with two gears.

In the meantime, though not shown, the motor may be mounted below the vibration case 40. In this instance, the rotation shaft of the motor 48 is directly connected to the vibration case 40 vertically, i.e., under the vibration case 40 directly in an up/down direction. This structure dispenses with the rotation guide 42*a* and the roller 42*b* described with reference to FIG. 2.

Figure 7:
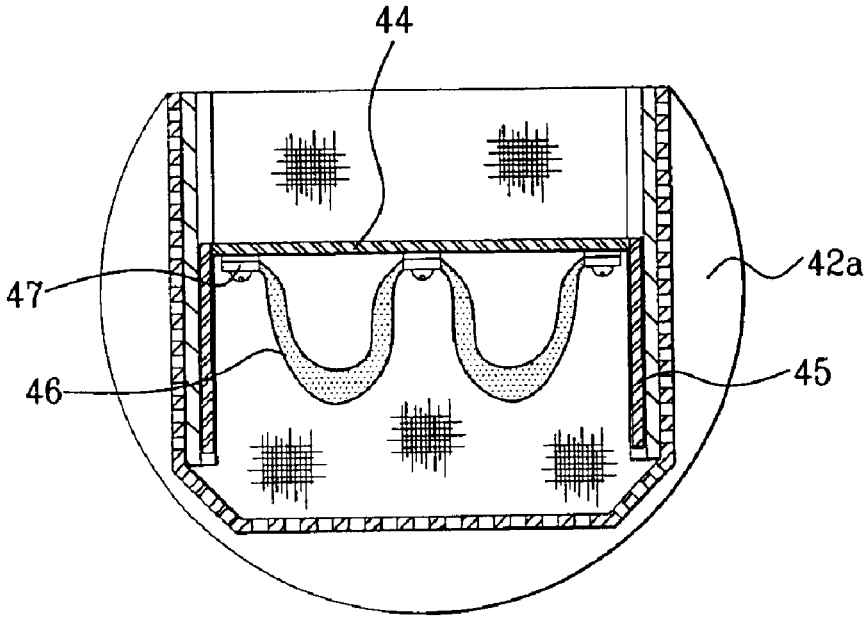
FIG. 7 illustrates a section of the cooling and shaking means in FIG. 6.

In the meantime, the cold accumulation pack 46 is mounted on an inside of the vibration case 40 rotated by the motor 48. The cold accumulation pack 46 cools down the drink quickly, with the cold accumulation pack 46 in close contact with the drink container introduced into the vibration case 40. As described, the cold accumulation pack 46 includes a liquid phase cold accumulation material, and a soft bag for storing the cold accumulation material therein. Description of a general structure of the cold accumulation pack 46, given already, is omitted, and a description of a mounting structure of the cold accumulation pack 46 in the vibration case will be given, with reference to FIGS. 6~8. For reference, FIG. 7 illustrates a section of the cooling and shaking means in FIG. 6, and FIG. 8 illustrates a section showing a cold accumulation pack provided further toward a bottom of the cooling and shaking means in FIG. 6.

Referring to FIG. 6, the cold accumulation pack 46 is provided such that a part of the cold accumulation pack 46 is attached to an underside of the door 44, and the other part sags downward. The cold accumulation pack 46 is fixed to the underside of the door 44 at opposite ends and center part thereof with, for an example, a plurality of supporting bars 47. The supporting bar 47 is long and thin, and, as shown in FIG. 6, disposed in parallel to a direction the drink container is inserted through the opened front of the body 41 of the vibration case 40. The supporting bar 47 is fastened to the underside of the door 44 with, for an example, a screws 47*a*. Once the soft cold accumulation pack 46 is mounted thus, as shown in FIG. 7, parts of the cold accumulation pack 46 not fixed to the underside of the door 44 with the supporting bars 47 sags downward. The drink container is introduced between the part sagged downward, such that the cold accumulation pack 46 and an outside surface of the drink container are brought into close contact.

Figure 8:
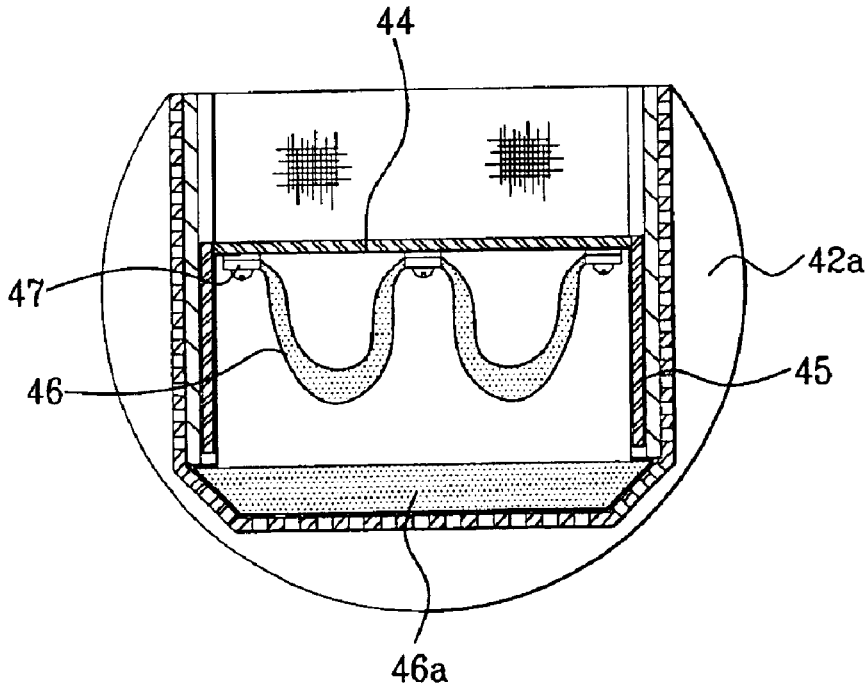
FIG. 8 illustrates a section showing a cold accumulation pack provided further to a bottom of the cooling and shaking means in FIG. 6.

Referring to FIG. 8, the cold accumulation pack may be provided, not only to the underside of the door 44, but also on a bottom surface of the body 41. The cold accumulation pack 46*a* on the bottom of the body 41 is identical to the cold accumulation pack 46 provided to the underside of the door 44. The cold accumulation pack 46*a* requires no particular supporting bars in mounting on a bottom surface of the body 41, as far as the cold accumulation pack 46*a* is attached so as not to move during the vibration case 40 rotates. If the cold accumulation packs 46 and 46*a* are respectively mounted on the underside of the door 44 and on the bottom of the body 41, since the drink container introduced into the body 41 is surrounded with the cold accumulation packs 46 and 46*a* at upper, lower, and opposite sides thereof, a contact area of the drink container with the cold accumulation packs 46 and 46*a* can be made larger, to increase a heat transmission surface, that permits faster cooling of the drink.

Figure 9A:
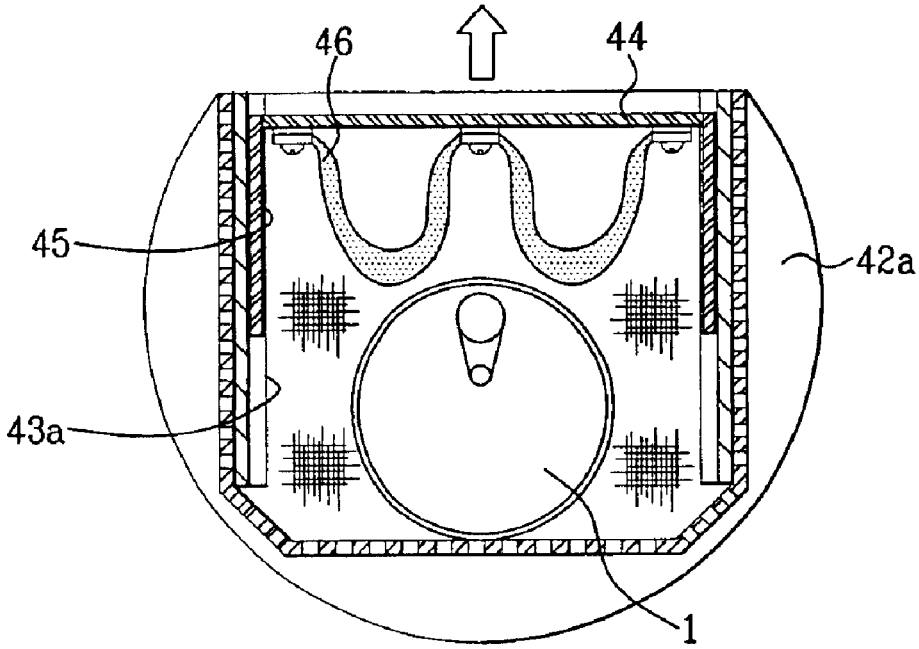
FIG. 9A illustrates a section showing a drink container is inserted in the cooling and shaking means in FIG. 7.
Figure 9B:
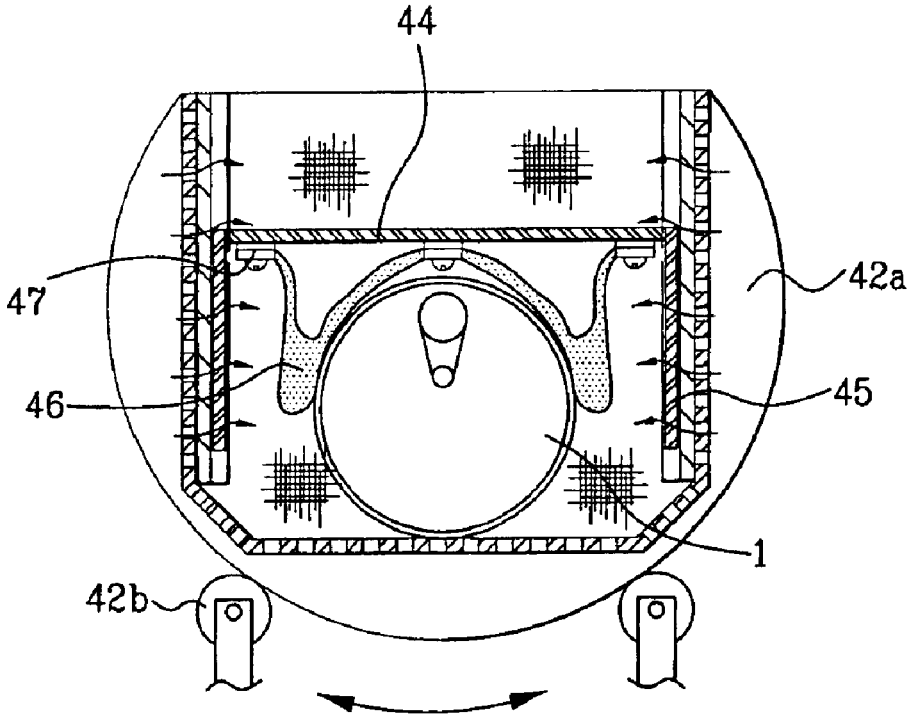
FIG. 9B illustrates a section showing operation of the cooling and shaking means in FIG. 7.

The operation of the quick cooling device in accordance with a first preferred embodiment of the present invention will be described with reference to FIGS. 9A and 9B. Fore reference, FIG. 9A illustrates a section showing a drink container is inserted in the cooling and shaking means in FIG. 7, and FIG. 9B illustrates a section showing operation of the cooling and shaking means in FIG. 7.

The refrigerating system in the quick cooling device of the present invention is put into operation when the drink container is not in the case 10. Upon putting the refrigerating system into operation, the compressor 31 compresses the gas refrigerant to a high pressure and provides it to the condenser 32. The condenser 32 condenses the high pressure refrigerant into a low pressure liquid refrigerant. Then, the refrigerant passes through the strainer 35, and is introduced into the evaporator 34 via the expansion device 33. The refrigerant introduced into the evaporator 34 evaporates and absorbs heat from its surroundings. The fan 34*a* blows cold air around the evaporator 34 toward the cavity 11, including the vibration case 40 having the cold accumulation pack 46. According to this, a temperature of the cold accumulation pack 46 is always kept low while the refrigerating system is in operation. As the cold accumulation material in the cold accumulation pack 46 has a freezing point in a range of −7° C.~−20° C., the cold accumulation material does not freeze at a very low temperature. According to the above process, the refrigerating system can maintain the cavity 11 at a fixed temperature.

In a state the cold accumulation pack 46 is maintained at a lower temperature by the refrigerating system, the door 20 is opened, and a drink container 1 is introduced into the vibration case 40. In this instance, as shown in FIG. 9A, after lifting the door 44 of the vibration case 40 upward, the drink container 1 is inserted into an inside of the body 41 through the opened front part of the body 41. Then, when the drink container 1 is inserted into the inside of the body 41 fully, the door 44 is put down. The lifting and putting down movements of the door 44 are guided by sliding sticks 45 and the sliding guides 43. As shown in FIG. 9B, when the door 44 is moved down fully, the sagged part of the cold accumulation pack 46 surrounds, and comes into close contact with, an outside surface of the drink container 1.

In a state the cold accumulation pack 46 is in close contact with the drink container 1, power is provided to the motor 48. Then, as shown in FIG. 9B, the vibration case 40 rotates within a predetermined angle in clockwise and anti-clockwise directions alternately. In this instance, the rotation guide 42*a*, and the roller 42*b* guide smooth rotation of the vibration case 40. When the vibration case 40 rotates, the drink stored in the drink container 1 is also shaken, to make convection. Moreover, the liquid cold accumulation material in the cold accumulation pack 46 is also caused to make convention. Heat transfer between the drink and the cold accumulation material become active as the drink and the cold accumulation material are caused to make convection. In this instance, since the cold accumulation material is at a subzero temperature in a liquid state, the drink container 1 and the drink therein are cooled down, quickly.

When a preset time period is passed, the motor 48 stops, and cooling of the drink is finished. Then, the door 20 is opened, and the drink container 1 is taken out after lifting the door 44 upward.

Thus, the quick cooling device of the present invention can shorten a cooling time period of a drink by shaking the subzero cold accumulation pack 46 and the drink container 1 in a state the cold accumulation pack 46 and the drink container 1 are in close contact, that maximizes convective heat transfer between the cold accumulation material and the drink.

In the meantime, the cooling and shaking device in the quick cooling device of the present invention may be embodied in a system different from the foregoing system. A cooling and shaking device employed in a quick cooling device in accordance with a second preferred embodiment of the present invention will be described with reference to the attached drawings. For reference, the second embodiment of the present invention has a system identical in a large portion and different in a small portion with the system described with reference to FIGS. 2~9B, except the cooling and vibrating device. Therefore, only difference of the cooling and shaking device will be described. In describing the embodiment, parts the same with the embodiment described with reference to FIGS. 2~9B will be given the same names and reference symbols.

Figure 10:
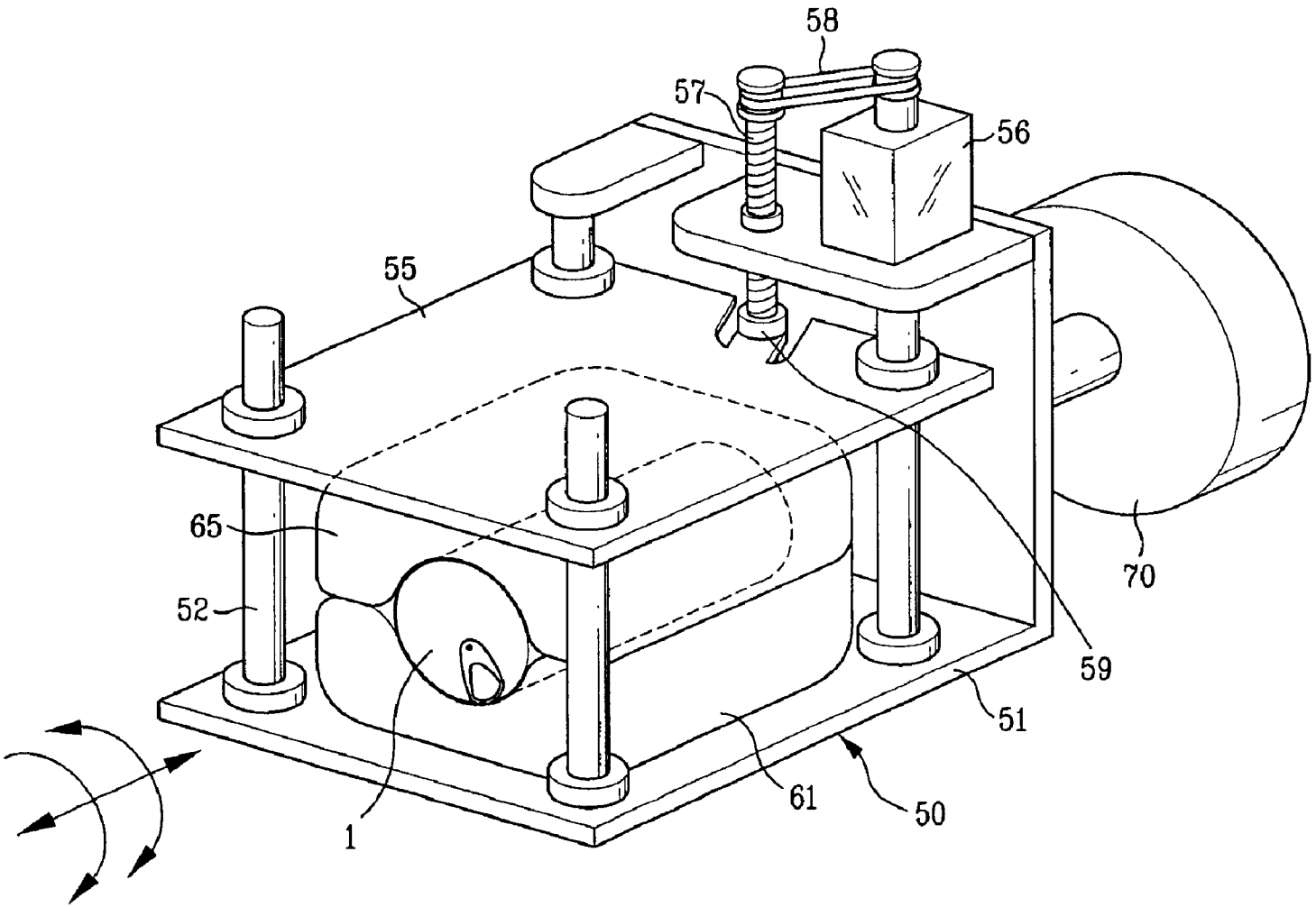
FIG. 10 illustrates a perspective view showing cooling and shaking means in a quick cooling device in accordance with a second preferred embodiment of the present invention.
Figure 11:
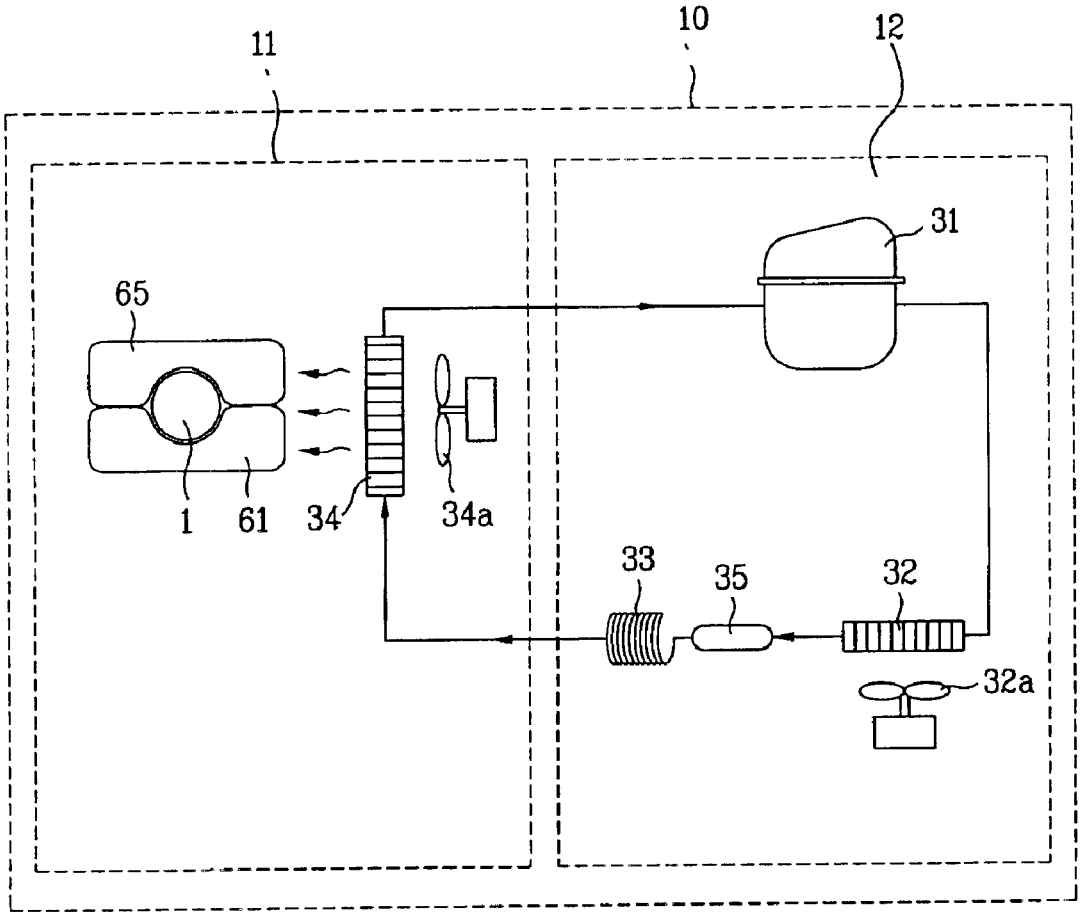
FIG. 11 illustrates a diagram showing a system of a quick cooling device in accordance with a second preferred embodiment of the present invention.

FIG. 10 illustrates a perspective view showing cooling and shaking means in a quick cooling device in accordance with a second preferred embodiment of the present invention, and FIG. 11 illustrates a diagram showing a system of a quick cooling device in accordance with a second preferred embodiment of the present invention. Referring to FIG. 10, it can be noted that the cooling and vibrating means in accordance with a second embodiment of the present invention includes first, and second cold accumulation packs 61 and 65, a frame 50, and a vibrating device.

The first, and second cold accumulation packs 61 and 65 are formed of separate soft bodies. Each of the first and second cold accumulation packs 61 and 65 is formed of a cold accumulation material and a soft bag for storing the cold accumulation material therein. The first and second cold accumulation packs 61 and 65 have systems identical to the cold accumulation pack 46 described with reference to FIGS. 2~9B, and description of which will be omitted. However, mounting structures of the first and second cold accumulation packs 61 and 65 will be described briefly in description of the frame 50.

The frame 50 is provided in the cavity 11, and includes a base 51, an elevating plate 55, and an elevating device. As shown in FIG. 10, the base 51 has an "L" bent form. The first cold accumulation pack 61 is fixed to one of horizontal bottom surfaces, for an example, upper surface of the base 51. The shaking device is connected to a vertical part of the base 51. The shaking device will be described, later.

The elevating plate 55 is provided in an upper side or lower side space of the base 51 parallel to, and spaced a distance apart from the horizontal bottom surface of the base 51. FIG. 10 illustrates an example the elevating plate 55 is provided to the upper space of the horizontal bottom surface of the base 51. As shown in FIG. 10, the second cold accumulation pack 65 is fixed to an underside of the elevating plate 55. Therefore, the first and second cold accumulation packs 61 and 62 are arranged oppositely between the base 51 and the elevating plate 55.

The elevating plate 55 moves up/down in a space over the base 51 by the elevating device. The elevating device moving the elevating in an up/down direction includes guide members for guiding the elevating plate 55 in the up/down direction and a driving device.

The guide members stand vertical on the horizontal surface of the base 51, and extend to pass through the elevating plate 55. As shown in FIG. 10, the guide member may be, for an example, a plurality of guide rods 52. The guide rods 52 stand upward vertically on corners of the horizontal surface of the base 51, and extend to pass through the corners of the elevating plate 55. According to above structure, the elevating plate 55 is made to move in an up/down direction following guidance of the guide rods 52. The up/down direction movement of the elevating plate 55 together with the second cold accumulation pack 65 leads the first and second cold accumulation packs 61 and 65 come in close contact or move apart.

In one embodiment of the driving device, power of a motor 56 is used for moving the elevating plate 55 up/down. The driving device includes the motor 56, a screw 57, and a nut 59. As shown in FIG. 10, the motor 56 is fixed to one side of the frame 50, for an example, an upper part of a vertical part of the frame 50. The screw 57 is arranged parallel to the guide rod 52, to be rotatable by the motor 56. The screw 57 is extended to pass through, for an example, the elevating plate 55. As shown in FIG. 10, the nut 59 is engaged with the screw 57 at a position of the elevating plate 55 the screw 57 passes through.

The screw 57 may have the power of the motor 56 transmitted thereto by a variety of methods. As one example, the screw 57 and the rotation shaft of the motor 56 may be connected with a belt 58. In this system, a rotation power is transmitted from the motor 56 to the screw 57 through the belt 58. Though not shown, the screw 57 and the rotation shaft of the motor 56 may be connected with a chain, or two engaged gears. Or, without separate power transmission means, the screw 57 may be connected to the rotation shaft of the motor 56, directly. Because above systems can be known to persons skilled in the art only with above description, no separate drawings are shown.

In the meantime, the frame 50 is rotated in a clockwise or anti-clockwise direction, or moves back and forth by the shaking device. As shown in FIG. 10, the shaking device includes a motor 70 connected to a one side of a vertical part of the frame 50. The requirements of this embodiment for the motor 70 is met adequately as far as the motor 70 has a structure in which the rotation shaft of the motor 70 rotates in a clockwise or anti-clockwise direction, or moves back and forth along a rotation shaft direction.

Referring to FIG. 11, the second embodiment quick cooling device having the foregoing cooling and shaking device also provided with a refrigerating system. The refrigerating system cools down the first and second cold accumulation packs 61 and 65 mounted in the cavity 11. Since the refrigerating system is identical to the embodiment described with reference to FIGS. 2~9, no more description will be given.

Figure 12:
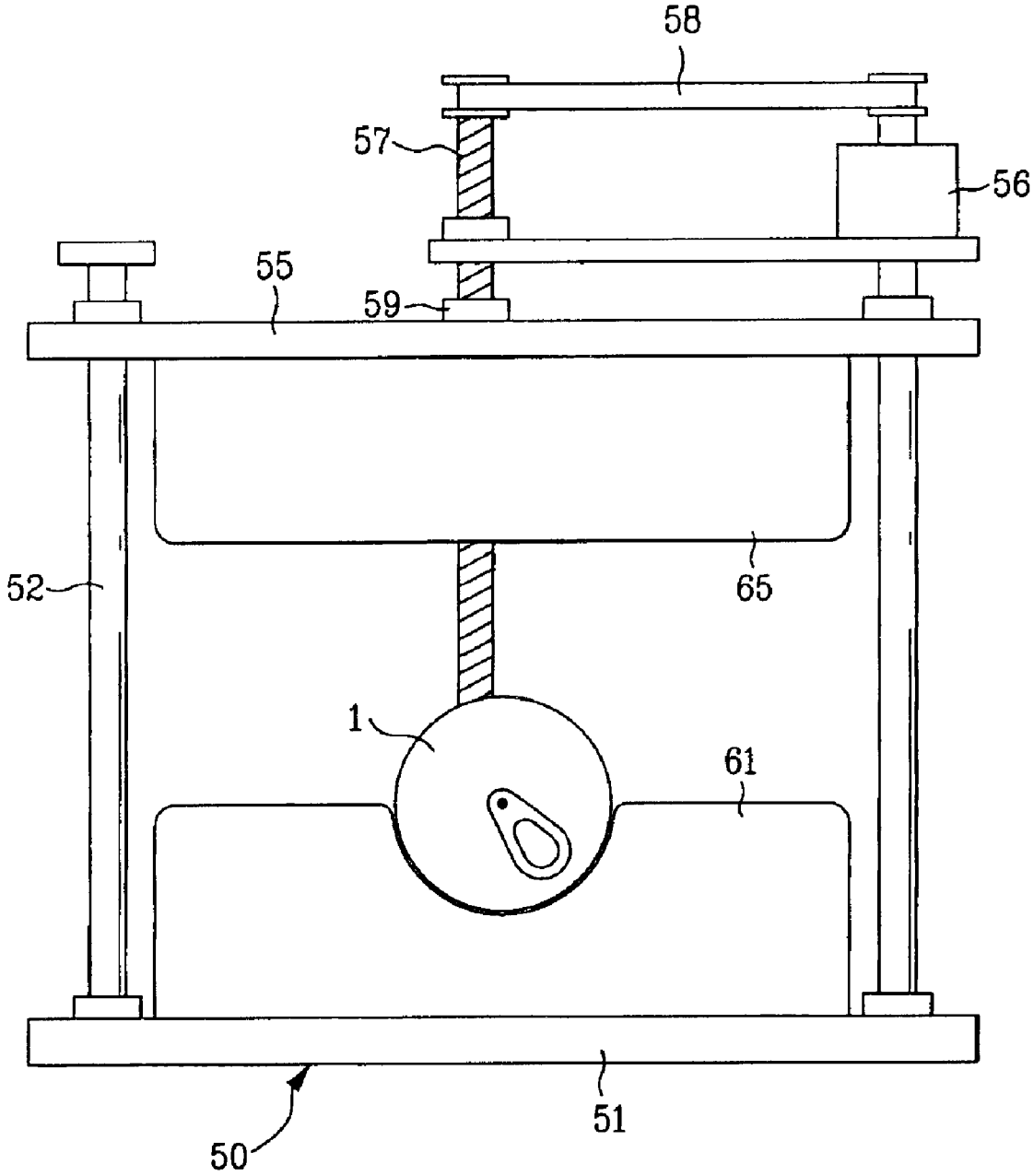
FIGS. 12 and 13 illustrate front views showing operation of the cooling and shaking means in FIG. 10 in succession.
Figure 13:
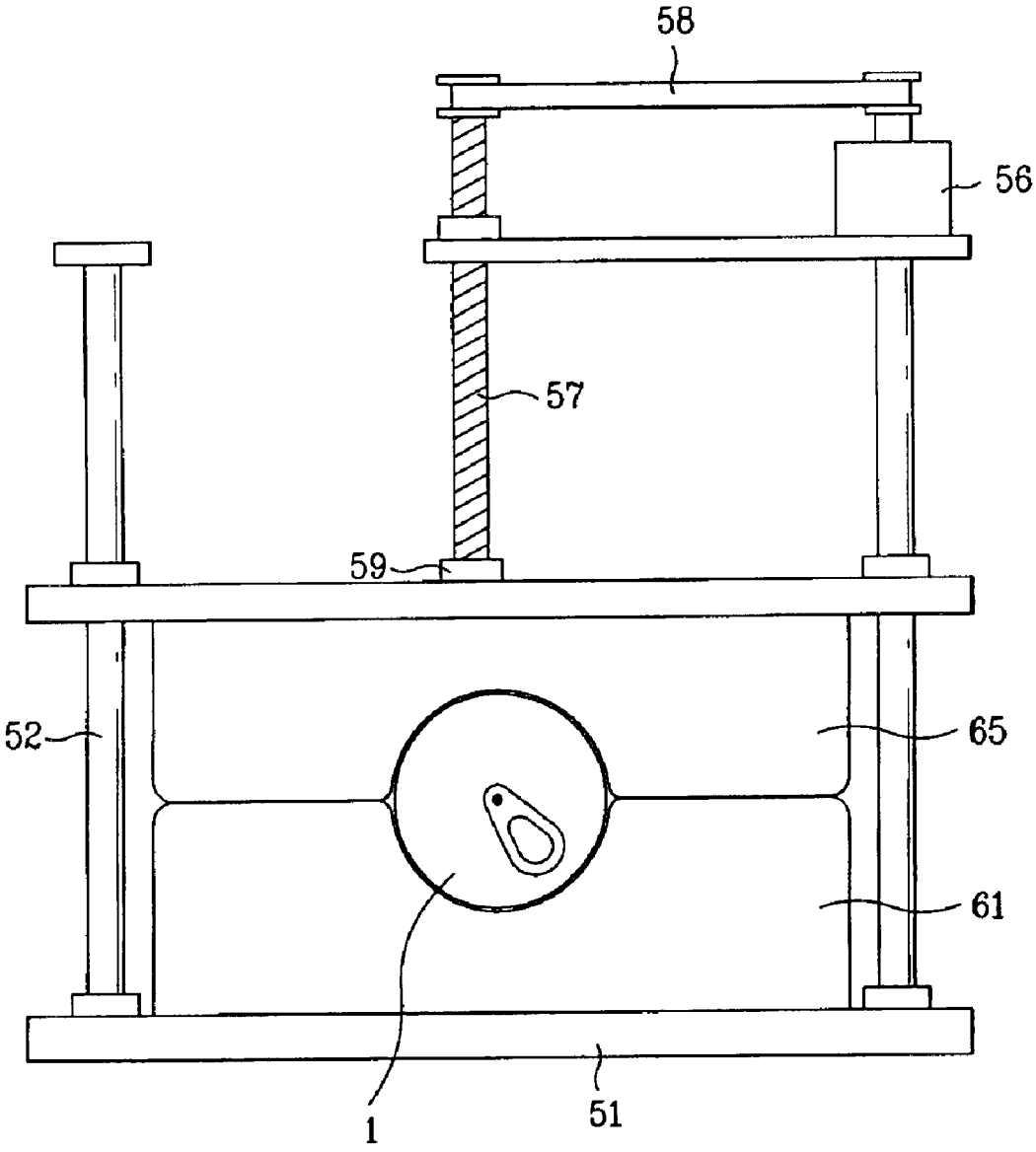

The operation of the second embodiment of the present invention will be described with reference to FIGS. 12 and 13. FIGS. 12 and 13 illustrate front views showing operation of the cooling and shaking means in FIG. 10 in succession.

The second embodiment quick cooling device also cools the cavity 11 and the first, and second cold accumulation packs 61, and 65 by means of the refrigerating system in a state the drink container is not introduced into the case 10 yet. Since the process is identical to the embodiment described with reference to FIGS. 2~9B, no more description will be given.

In a state the first and second cold accumulation packs 61 and 65 are cooled by the refrigerating system, the drink container 1 is introduced into the quick cooling device after opening the door 20 on the quick cooling device. In this instance, the elevating plate 55 is at a highest position. Therefore, as shown in FIG. 12, the first and second cold accumulation packs 61 and 65 are spaced apart. Under this state, as shown in FIG. 12, the drink container 1 is placed on the first cold accumulation pack 61. Then, the first cold accumulation pack 61 comes into contact with the drink container 1 to surround substantially a half of the outside circumferential surface of the drink container 1.

When the door 20 is closed after the drink container 1 is introduced, and the control panel is operated, the motor 56 is put into operation to rotate the screw 57. Then, the elevating plate 55 moves down slowly such that the second cold accumulation pack 65 and the first cold accumulation pack 61 come into contact. In this instance, the second cold accumulation pack 65 comes into contact with the drink container 1 to surround a rest half of the outside circumferential surface of the drink container 1. Thus, once the first and second cold accumulation packs 61 and 65 and the outside circumferential surface the drink container 1 come into contact, heat transfer is started, to cool down the drink in the drink container 1.

Then, the rotation shaft of the motor 70 is rotated in a clockwise or anti-clockwise direction, or moves back and forth. Then, the frame 50 also moves following movement of the rotating shaft. According to this, the cold accumulation material in the first and second cold accumulation packs 61 and 65 and the drink in the drink container 1 are shaken. The shaken liquid cold accumulation material and the drink make convective heat transfer active, to cool down the drink faster.

After a preset time period passed, the motor 70 is stopped and the cooling of the drink is finished. Then, the elevating plate 55 is moved up by the motor 56 and the screw 57. When the elevating plate 55 moves up fully, the door 20 is opened, and the drink container 1 is taken out of the quick cooling device in a state the same with FIG. 12.

In the second embodiment of the present invention too, by bringing the cold accumulation packs cooled down to a subzero temperature into contact with the drink container directly and shaking the cold accumulation packs and the drink container, the drink can be cooled down, very quickly.

Figure 14:
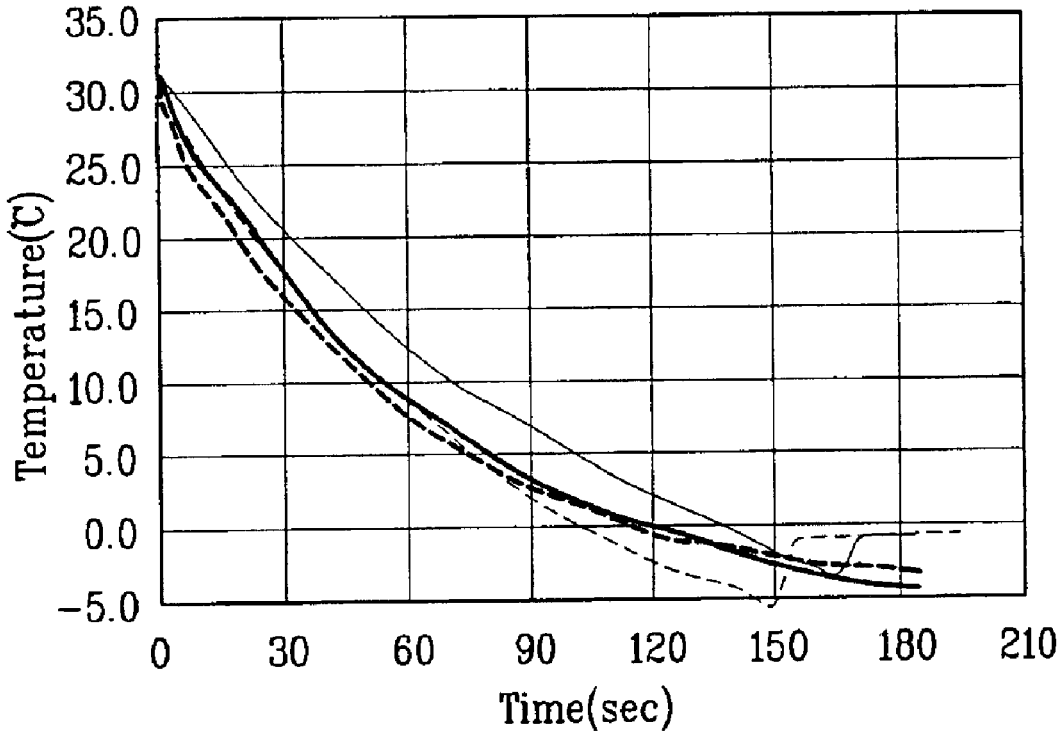
FIG. 14 illustrates a graph showing time vs. a temperature of a drink container during operation of the quick cooling device of the present invention.

In the meantime, FIG. 14 illustrates a graph showing a time period vs. a temperature of a drink container during operation of the quick cooling device of the present invention. Referring to FIG. 14, it can be known that the quick cooling device of the present invention can cool down drink from approx. 30° C. to approx. 0° C. for approx. 120 seconds.

The quick cooling device of the present invention may be fabricated to have an outer appearance similar to a microwave oven, and can be very useful at homes, stores, sports stadiums, athletic facilities and the like. If the control panel has a system for selecting kinds of drink and a time period intended to cool, the drink can be cooled to a temperature proper to the drink, you can enjoy the drink.

As has been described, the quick cooling device of the present invention has the following advantages.

First, the bringing of cold accumulation packs cooled down to a very low temperature into close contact with a drink container and shaking the cold accumulation packs with the drink container, that makes, not only conductive heat transfer, but also convective heat transfer active, the drink can be cooled down, very quickly.

The quick cooling capability permits to enjoy a proper taste of the drink any time, thereby satisfying desire of consumers.

It will be apparent to those skilled in the art that various modifications and variations can be made in the present invention without departing from the spirit or scope of the invention.

For an example, the evaporator may be mounted in the cold accumulation pack directly, for permitting the evaporator to make heat exchange with the cold accumulation material.

Thus, it is intended that the present invention cover the modifications and variations of this invention provided they come within the scope of the appended claims and their equivalents.

What is claimed is:

1. A quick cooling device comprising:

a case having an inside space divided into a cavity and a device chamber;

a cavity door on a front part of the case for opening/closing the cavity;

a structure in the cavity, for bringing a cold accumulation pack into contact with a drink container, and shaking the cold accumulation pack and the drink container together, to cool down a drink in the drink container; and a refrigerating system in the case for cooling the cold accumulation pack.

2. The quick cooling device as claimed in claim 1, wherein the case includes an insulating material attached to an inside surface of a wall of the cavity.

3. The quick cooling device as claimed in claim 1, wherein the cavity door is hinge coupled to one side of the case.

4. The quick cooling device as claimed in claim 1, wherein the case includes a front plate attached to a surface of the case and having the cavity door attached thereto so as to be in contact with the cavity door, the front plate having an opening from the cavity to an exterior of the case.

5. The quick cooling device as claimed in claim 1, wherein the refrigerating system includes:

a compressor for compressing and transferring refrigerant, a condenser for condensing transferred refrigerant, an expansion device for expanding condensed refrigerant, and an evaporator for cooling the cavity by a heat absorption reaction that occurs when the expanded refrigerant is evaporated.

6. The quick cooling device as claimed in claim 5, wherein the compressor and the condenser are in the device chamber.

7. The quick cooling device as claimed in claim 6, wherein the refrigerating system further includes a fan for blowing air to the compressor and the condenser.

8. The quick cooling device as claimed in claim 7, wherein the case includes:

an air inlet adjacent to the fan for introducing external air into the device chamber, and an air outlet adjacent to the compressor and the condenser for discharging the air cooled the compressor and the condenser to an exterior.

9. The quick cooling device as claimed in claim 5, wherein the evaporator is in the cavity.

10. The quick cooling device as claimed in claim 9, wherein the refrigerating system further includes a fan for supplying cold air around the evaporator to the cold accumulation pack.

11. The quick cooling device as claimed in claim 1, wherein the cold accumulation pack includes:

a cold accumulation material for being cooled down to a low temperature by the refrigerating system, and a soft bag for storing the cold accumulation material therein.

12. The quick cooling device as claimed in claim 11, wherein the cold accumulation material is a solution of sodium chloride, or potassium chloride.

13. The quick cooling device as claimed in claim 12, wherein the cold accumulation material has a freezing point in a range of −7° C.~−20° C.

14. The quick cooling device as claimed in claim 1, wherein the structure in the cavity includes:

a motor having a reversible rotation shaft, a shaking case for rotating in response to rotation of the rotation shaft, the shaking case including a plurality of holes and being disposed in the cavity, a low temperature cold accumulation pack in the shaking case configured to be brought into close contact with the drink container introduced into the shaking case, and rotating with the container, to cool down the drink in the drink container.

15. The quick cooling device as claimed in claim 14, wherein the structure in the cavity further includes:

a rotation guide having circular outside surface surrounding the shaking case, and a plurality of rollers in the cavity in contact with the rotation guide for supporting the shaking case and guiding rotation of the rotation guide.

16. The quick cooling device as claimed in claim 14, wherein the shaking case includes:

a body with a plurality of holes having an open front part and upper part, and a space therein, and a shaking case door for opening/closing the front and upper parts of the body.

17. The quick cooling device as claimed in claim 16, wherein the cold accumulation pack is mounted on an underside of the shaking case door in a soft state.

18. The quick cooling device as claimed in claim 16, wherein the cold accumulation pack is mounted on the underside of the shaking case door and on a bottom surface of the body.

19. The quick cooling device as claimed in claim 1, wherein the structure in the cavity includes:

first and second cold accumulation packs for surrounding an outside surface of the drink container therein from opposite sides, a frame in the cavity having the cold accumulation packs provided therein, and a shaking device for at least one of rotating the frame and reciprocating the frame along a straight line.

20. The quick cooling device as claimed in claim 19, wherein the first and second cold accumulation packs are formed of a soft material for deformation in conformity with an outside shape of the drink container with the drink.

21. The quick cooling device as claimed in claim 19, wherein the shaking device is a motor connected to one side of the frame for at least one of rotating the frame at least one of a clockwise or counterclockwise direction, and reciprocating the frame.

22. The quick cooling device as claimed in claim 19, wherein the frame includes:

a base having a surface to which the cold accumulation pack is fixed and a side to which the shaking device is connected, an elevating plate having a surface opposite to the first cold accumulation pack to which the second cold accumulation pack is fixed, the elevating plate configured to move up/down in a space one of over and under the base, and an elevating device for moving the elevating plate up/down.

23. The quick cooling device as claimed in claim 22, wherein the elevating device includes:

guide members each extending from the frame vertically and passing through the elevating plate, and a driving device for moving the elevating plate in an up/down direction along the members.

24. The quick cooling device as claimed in claim 23, wherein the driving device includes:

a driving motor fixed to one side of the frame, a screw parallel to the guide members and rotatable in response to rotation of the driving motor, and a nut fixed to the elevating plate and engaged with the screw.

* * * * *

UNITED STATES PATENT AND TRADEMARK OFFICE

CERTIFICATE OF CORRECTION

PATENT NO. : 6,945,069 B2
DATED : September 20, 2005
INVENTOR(S) : M.R. Lee et al.

It is certified that error appears in the above-identified patent and that said Letters Patent is hereby corrected as shown below:

Column 14,
Line 15, after "cooled" insert -- from --.

Signed and Sealed this

Second Day of May, 2006

JON W. DUDAS
*Director of the United States Patent and Trademark Office*